United States Patent [19]

von Tomkewitsch

[11] 4,350,970

[45] Sep. 21, 1982

[54] METHOD FOR TRAFFIC DETERMINATION IN A ROUTING AND INFORMATION SYSTEM FOR INDIVIDUAL MOTOR VEHICLE TRAFFIC

[75] Inventor: Romuald von Tomkewitsch, Ebenhausen, Fed. Rep. of Germany

[73] Assignee: Siemens Aktiengesellschaft, Berlin & Munich, Fed. Rep. of Germany

[21] Appl. No.: 201,697

[22] Filed: Oct. 29, 1980

[30] Foreign Application Priority Data

Nov. 13, 1979 [DE] Fed. Rep. of Germany ..... 2945852

[51] Int. Cl.[3] ..... G08G 1/09

[52] U.S. Cl. ..... 340/23; 340/40; 364/436

[58] Field of Search ..... 340/23, 24, 40, 35; 235/61 NV; 364/424, 436

[56] References Cited

U.S. PATENT DOCUMENTS

| | | | |
|---|---|---|---|
| 2,980,887 | 4/1961 | Soderberg | 340/40 |
| 3,845,289 | 10/1974 | French | 364/436 |
| 3,925,641 | 12/1975 | Kashio | 340/23 |
| 3,984,806 | 10/1976 | Tyler | 340/23 |
| 4,009,375 | 2/1977 | White et al. | 364/424 |
| 4,220,946 | 9/1980 | Henriot | 340/23 |
| 4,251,797 | 2/1981 | Bragas et al. | 340/23 |

*Primary Examiner*—Glen R. Swann, III

*Attorney, Agent, or Firm*—Hill, Van Santen, Steadman, Chiara & Simpson

[57] ABSTRACT

In a method for traffic determination, a routing and information system for individual motor vehicle traffic is used, in which by way of stationary routing station poles, route information and local information are transmitted to the passing vehicles. For the determination of the traffic situation, the traveling times between two routing station poles are measured in individual vehicles with timing units. These traveling times are transmitted, together with the local information of the first routing station pole passed by a vehicle, to the second routing station pole and are considered in determining new route recommendations.

9 Claims, 6 Drawing Figures

LB: 1
VK: 1

| LP | x | y | s' | w' | s | w | t | h | a |
|---|---|---|---|---|---|---|---|---|---|
| 0 | 120 | 580 | | | | | | | |
| 1 | 165 | 580 | (46) | (88) | 45 | 90 | 3 | — | — |
| 2 | 165 | 530 | (52) | (178) | 50 | 180 | 2 | — | — |
| 3 | 205 | 505 | (49) | (118) | 48 | 120 | 10 | 7 | — |
| 4 | 245 | 505 | 41 | 89 | 40 | 90 | 5 | — | — |
| 5 | 290 | 505 | | | 45 | 90 | | | |
| 8 | 330 | 505 | | | 40 | 90 | | | |

METHOD FOR TRAFFIC DETERMINATION IN A ROUTING AND INFORMATION SYSTEM FOR INDIVIDUAL MOTOR VEHICLE TRAFFIC

BACKGROUND OF THE INVENTION

1. Field of the Invention

The present invention concerns a method for traffic determination in a routing and information system for individual motor vehicle traffic, having stationary routing station poles arranged in the vicinity of roadways, which poles transmit route information and location information concerning their positions to the passing vehicles, whereby, in the individual vehicles, in each case a trip destination is set forth and, corresponding thereto, certain routing recommendations are selected, in accordance with certain known techniques, whereby further, in each case, the trip destination data are transmitted from the vehicle to the routing station pole and are evaluated for obtaining data concerning the general traffic situation.

2. Description of the Prior Art

The prior technique noted above is set forth in German patent application No. 29 23 634.8 which specifies a routing and information system in which, from the individual routing station poles, the routing information for all trip destinations which could come into consideration are transmitted cyclically to all passing vehicles. The selection of the recommendations which are applicable for a specific trip destination occurs in the vehicle. This has the advantage with respect to other known systems that for a pure destination guidance, only one transmission in one direction is required, namely, from the routing station poles to the vehicles. In contrast thereto, in the case of other known systems, it is provided that first the trip destination is provided from the vehicle to the routing station pole, that then, there the associated information is selected and is transmitted to the vehicle. The information transmission thus proceeds in a dialog between the routing station poles and each individual vehicle.

Although this is not absolutely necessary in the case of the method of the German application No. P 29 23 634.8, it is there, however, also possible to transmit information concerning the selected trip destination from the individual vehicle to the routing station pole. In this case, however, this does not serve for the selection of specific routing recommendations, but rather for obtaining general data concerning momentary traffic buildup and traffic buildup to be expected at the trip destinations. Such information can either be evaluated in the routing station pole itself or in a parent routing central station and can be used for determining new routing recommendations.

For determination of traffic situation, previously detectors were used with which at significant points of the road system, the number, the direction, the velocity and, where applicable, the type of passing vehicles are determined or, respectively, the time gaps and the level of occupancy are measured. From these values, one indirectly determines the occupancy state of entire stretches of road, although these measured values only provide information concerning the traffic currents at the narrowly limited measured intersection. A traffic obstruction between two measuring points which are distant from one another, for example, is not perceived as long as the traffic in front of and behind these measuring locations remains fluid.

SUMMARY OF THE INVENTION

It is the object of the present invention to provide a measuring method for traffic determination, with which the traffic situation over an entire stretch can be determined and evaluated quickly and reliably.

According to the invention, the above object is achieved with the use of a routing and information system, in particular a system of the type set forth in German application No. P 29 23 634.8, in that the address of the routing station pole as well as a start command for a time measuring device which is provided in the vehicle is transmitted from the individual routing station poles to the passing vehicles, that with the start command in each case the time measuring device is activated and that the measured traveling time, together with the address of the preceding routing station pole and the route recommendations there obtained is transmitted to the following routing station pole in each case.

According to the method of the present invention, the vehicles themselves are used as measuring objects and data carriers. With arrival of the vehicle at a routing station pole, it is interrogated and reliably provides information concerning the actual traveling time. From the measured traveling times of a rather large number of vehicles, the traffic situation can be determined very accurately in the appertaining path segment. It thereby suffices thoroughly if only a part of the vehicles is provided with a destination guidance device and can also be interrogated for the traveling time measurement. These individual interrogatable vehicles move in the general flow of traffic and thus form individual flow measuring devices, from the traveling behavior of which a reliable conclusion is possible concerning the total traffic situation.

In a practical manner, in the measuring station poles, changing means values are formed from the measured traveling times of the individual vehicles. By providing such changing mean value formation, tendencies of the traffic flows are quickly recognized. The anomalous behavior of individual vehicles thus remains without significant influence.

In general, the routing station poles in each case are arranged at rather large distances from one another. The stretches therebetween can be described as a series of path vectors. Correspondingly, in German application No. P 29 23 634.8 it is provided that from the routing station poles to the vehicles, in each case, routing recommendations are provided in the form of a chain of route vectors. Correspondingly, it is also practical that the traveling times are measured individually in the vehicle in each case between the individual route points of a route vector chain, are stored in the vehicle and are transmitted to the following route station pole together with the data of the route vector chain. Hereby, a more precise determination of the traffic situation is possible even in the case of large distances between the routing station poles.

If a vehicle does not follow the routing suggestion, then this can be determined in the vehicle with a navigation device. In a practical manner, such a deviation from the route recommendation can be announced to the next routing station pole and evaluated. In the routing station pole, the number of the vehicles which deviate from the route recommendations can be stored and evaluated for judging the traffic situation. If, for example, such announcements accumulate at specific route points, then this fact can also be announced to a parent master route computer. This is an indication that either a route point was not provided with correct coordinates or that, in fact, in this vicinity, a traffic obstruction is present. It can then be checked whether this obstruction is of long duration. Where applicable, the appertaining route recommendation must be modified. Further, it can be provided that the time measurement in the vehicle is interrupted when the vehicle stops and the motor is turned off.

In a further development of the invention, in addition, it can be provided that route instructions are transmitted between neighboring routing station poles by the vehicles. In this case, along with the route recommendation messages for their own vehicle's traveling direction, also instructions concerning route vector chains which are to be recommended for the next routing station poles can be transmitted to the vehicles. Such information can be stored in the vehicle in each case and with passing of the next routing station pole, can be interrogated. With this technique, in a simple manner, information can be transmitted to the next measuring station pole as to which path should be recommended to the vehicles having the opposite traveling direction. In this manner, a traffic-dependent routing system for a local zone can be realized, with a selection logic for alternative routes in the individual routing station poles and the devices for the transmission back of the routing instructions with the use of the vehicle devices, without the necessity of providing a parent master computer. In a further design of the invention, it is, however, provided to permit the measured traffic times and other information, such as path deviations, to be transmitted to a central master computer and be evaluated for establishing new route recommendations.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figures 1, 2:
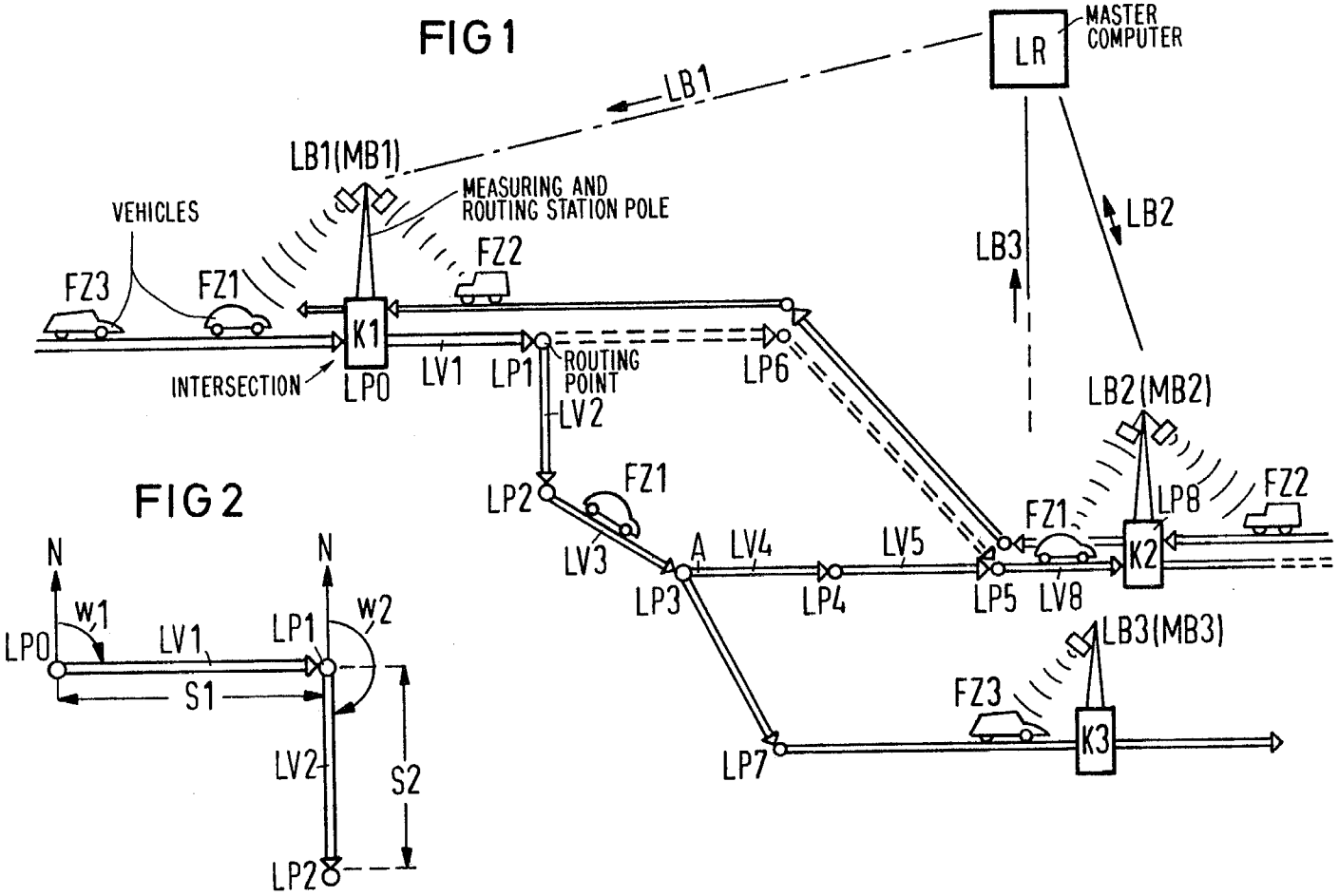
FIG. 1 is a schematic illustration of a road system in a limited region.
FIG. 2 illustrates a portion of the schematic diagram of FIG. 1 for an explanation of route vectors.

Referring to FIG. 1, a schematic illustration of a road system in a limited region is shown as comprising intersections or crossing points K1, K2 and K3 of vehicles with respect to routing station poles. Because of the separation of the two functions, here it is differentiated in each case between a routing station pole LB1, LB2, etc and a measuring station pole MB1, MB2, etc. In practice, routing station poles and measuring station poles will be housed in a single device at the street crossing. For this reason, in the following, in each case only a routing station pole is discussed, which can both transmit route recommendations as well as receive information.

For the presentation on the drawing, the following course of traffic is assumed:

a vehicle FZ1 approaches the crossing K1 and receives a route recommendation from the routing station pole LB1 to use the route described by the route points LP1—LP5;

at the crossing, from the routing station pole LB2 it receives a further route recommendation message for the following segment of the path; and simultaneously with the above message, the vehicle device is activated to transmit to the measuring station pole MB2 (combined with the routing station pole LB2) among other things, the measured traveling times of the preceding segments of the stretch.

After interrogation of a series of vehicles by the measuring station pole MB2 and after the evaluation of these measured traveling times, the station can come to the conclusion that the route via the route points LP1 and LP6, after LP5, is more favorable in the case of the given traffic situation. This information is provided to vehicles in the opposing direction, for example, to the vehicle FZ2. The transmission of this information occurs additionally to the route recommendations with the vehicle FZ2 would naturally receive from the routing station pole LB2. If the vehicle FZ2 then passes the routing station pole LB1 or, respectively, the measuring station pole MB1, in addition to its own measured traveling time, also this route recommendation which was sent with the vehicle is interrogated, stored and used for the correction of the route recommendations for the further passing vehicles.

Behind the vehicle FZ1, the vehicle FZ3 approaches the crossing K1. Let it here be assumed that the vehicle FZ3 still obtains the same route recommendation as the vehicle FZ1, thus the route vectors via the route points LP1–LP5. This vehicle, however, deviates at the route point LP3 from the recommendation, because, for example, a police officer undertakes a detour because of an accident at the point A. The vehicle thus does not proceed to the crossing K2, but rather proceeds by way of the point LP7 to the crossing K3 and announces to the measuring station pole MB3 that it has left the recommended route at the point LP3. If many other detoured vehicles arrive at the measuring station pole MB3, then a corresponding announcement is provided to the parent master computer LR. This can by itself directly instruct the routing station pole LB1 to recommend an alternative route to the crossing station K2 to further vehicles.

The meaning of the route vectors is presented in FIG. 2 from a section taken from FIG. 1. Each route vector LV1, LV2, etc is determined as to its value (absolute value) s1, s2, etc and through its angle value w1, w2, etc with respect to a predetermined direction, for example, the angle with respect to the northern direction N.

Figure 3:
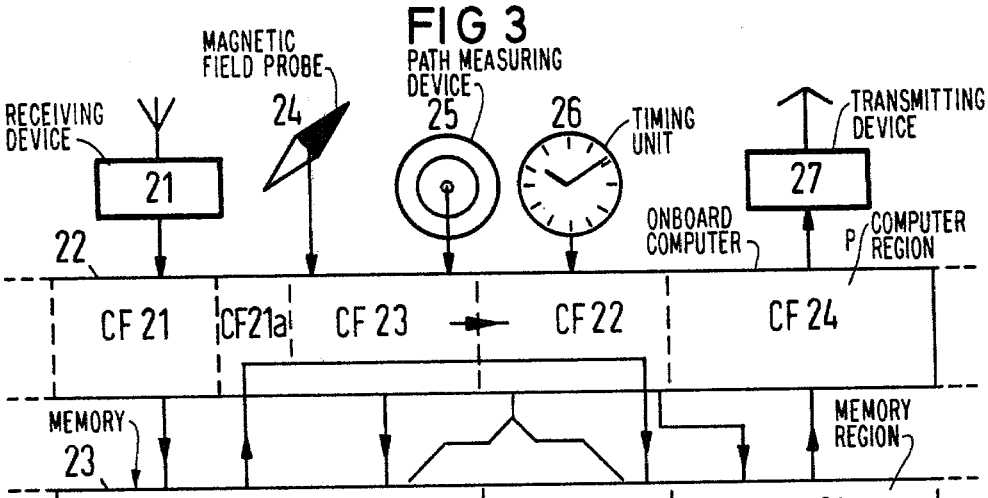
FIG. 3 illustrates the devices in a vehicle for practicing the present invention.

In FIG. 3, the vehicle devices are schematically presented, in order to illustrate the obtaining of the empirical values in the vehicles. Each vehicle has a receiving device 21, which with passing of a routing station pole (for example LB1) receives data which are transmitted from the routing station pole. These data messages are checked for transmission errors and are prepared in an onboard computer 22, and specifically in the region CF21, in a manner which is not illustrated in detail. From these data messages, all data are extracted which concern route recommendations, and are stored in the memory region SB21 of a memory 23. Individually, this thereby concerns the following data:

(a) the address (LB "1") of the routing station pole LB which was just passed;

(b) the address (VK "1") of the recommended route vector chain VK; and (c) the coordinates (xy) of all route points LP of the recommended vector chain. Such a vector chain in FIG. 1 is, for example, LP0, LP1–LP8.

Directly after the storage of such data, the onboard computer 22, in the function region CF21*a*, calculates the coordinates of the route point x, y, the values s and the angles w for the individual route vectors LV1, LV2, etc. These values are stored in the memory region SB22 of the memory 23.

In the computer region CF23, the dead reckoning navigation operation, which is known per se, is carried out. Proceeding from the coordinates of the route points LP0 (that is, from the coordinates of the last-passed routing station pole, in the example of FIG. 1 from the coordinates of the routing station pole LB1), from the traveling direction measurement obtained by a magnetic field probe 24 and from the path pulses of a path measuring device 25, the stretch of the path which has been traveled is determined as to a value s' and a direction w' and is stored in the memory region SP23. Because of unavoidable measurement errors, these values s' and w' which are determined deviate somewhat from the actual values s and w.

In the computer region CF22, it is checked whether the deviations stay within predetermined limits; in the case of an impermissibly large deviation, an alarm signal "a" is set and is stored in the memory region SB24. In the case of an unconsequentially small deviation, that is, a deviation too small for immediate concern, a correction is undertaken as soon as a marked direction change makes possible new conclusions concerning the actual position of the vehicle. For example, at the route point LP1 (FIG. 1) there occurs a marked direction change of 90°. As soon as this direction change is recognized via the magnetic field probe 24 in the navigation device CF23, the coordinates of this route point are used as a starting point for further dead reckoning navigation. In addition, in the computer region CF22, with the help of the timing unit 26, the traveling time "t" is determined which was required for the traveling of the path distance specified for a specific route vector LV. This traveling time t is stored for each route vector in the memory region 24. In addition, possible stationary times "h", for example, in front of traffic signals, are measured with the help of the timing unit 26 and the path measuring device 25 and are also stored in the memory region SB24.

The values t, h and a are thus stored in the memory region SB24, and specifically in such a manner that one can associate the same in each case without ambiguity to the route vectors LV or, respectively, to the route points LP (in the memory region SB21).

In the computer region CF24, the empirical values t, h and a, in combination with the address of the originating routing station pole, the route vector chain and the route points, respectively, route vectors, are transmitted to the next routing station pole via the transmitting device 27.

Figure 4:
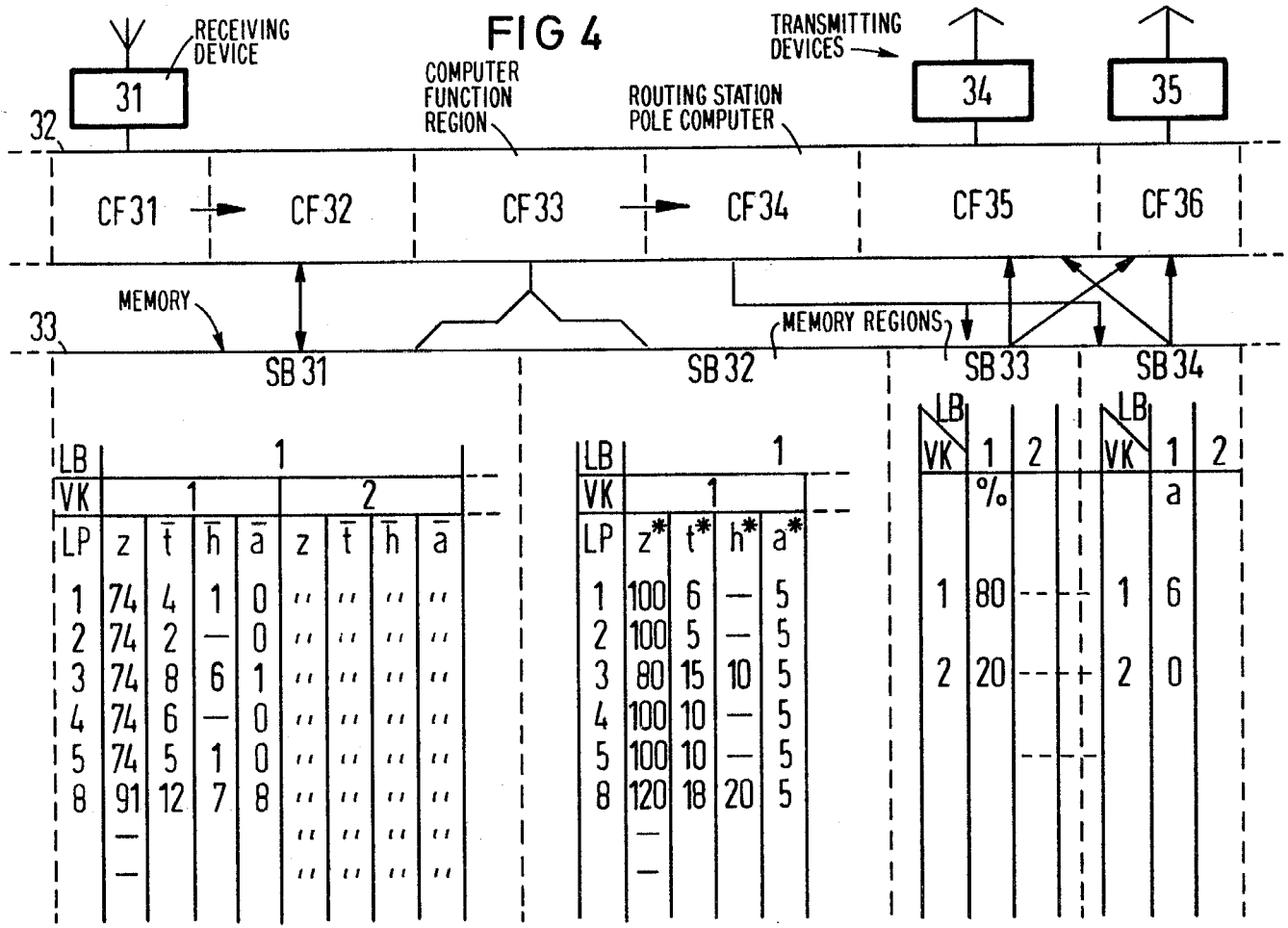
FIG. 4 illustrates the devices in a routing station pole for practicing the invention.

FIG. 4 illustrates the devices in the routing station poles in each case for the processing of empirical values transmitted from the vehicles. The receiving devices 31 of the routing station poles (for example, LB2 in FIG. 1) receive the data messages of all passing vehicles. The messages are checked in a function region CF31 of the routing station pole computer 32 in a manner not described in detail herein. The routing station pole computer takes from these messages the transmitted empirical values t, h and a (as was done in connection with FIG. 3) and delivers the same to the function regions CF32.

In the region CF32, the number z of the vehicles per time interval from which data are received is counted. Further, the changing mean values $\bar{t}$, $\bar{h}$ and $\bar{a}$ of the empirical values t, h and a are calculated. These values are stored in the memory region SB31 of a memory 33 and specifically are associated without ambiguity to the originating station pole LB, in each case with the associated address, for example, LB "1", the route vector chain VK which was used with its address, for example, "1" or "2", as well as the route points LP1, LP2, etc.

In the memory region SB32, the reference values z*, t*, h* and a* determined, for example, by traffic engineers for the values z, t, h and a which were mentioned above are stored according to the same ordering principle. The route selection pole computer 32 now continuously checks, in its operating region CF33, to what extent the number of vehicles z from which the empirical values were received and the mean empirical values approximate the reference values z*, t*, h* and a*, or exceed these values. Depending upon these relationships, the route station pole computer 32 in the operating region CF34 determines how, for example, the distribution of the traffic approaching by way of the routing point LP0 (routing station pole LB1) should be undertaken onto the different possible travel routes. For the computation of the distribution values, which is not presented in greater detail herein, the mean traveling times t, the mean stopping times h, however, also exceedings of the predetermined alarm reference values a* per path segment, are used.

These distribution values are stored in the memory region SB33. In the example of FIG. 4, it is assumed that the traffic from the routing station pole LB1 should be divided in the ratio of 80% to 20% between the route vector chains VK1 and VK2. The route vector chain with the address "1" encompasses the distance between the route points LP1, LP2, LP3, LP4, LP5 and LP8, while the route vector chain with the address "2" encompasses the distance between the route points LP1, LP6, LP5 and LP8.

In a comparable manner, exceedings of the alarm values are registered in the memory region SB34. In the example of FIG. 4, it is assumed that the number of alarm values of the vector chain with the address "1" from the routing station pole with the address "1" at the route point LP8 is higher than the appertaining reference value a* permits. This is already recognizable from the alarm value a=8 in the memory region SB31 at the route point LP8, which value is larger than the corresponding reference value a*=5 in the memory region SB32.

Corresponding tables for the distribution and alarm values are provided for all neighboring route station poles with the addresses "2", "3", etc in the memory regions SB33 and SB34.

The region CF35 of the computer 32 compiles the data messages for the transmission of the distribution values, including the associated addressing, to all vehicles which approach the routing station pole LB2. This message is transmitted by way of the transmitting device 34.

In the region CF36 of the computer 32, a corresponding data message is compiled for the transmission of the distribution and alarm values to a parent master computer. The transmission of this data message proceeds by way of the transmitting device 35.

Figure 5:
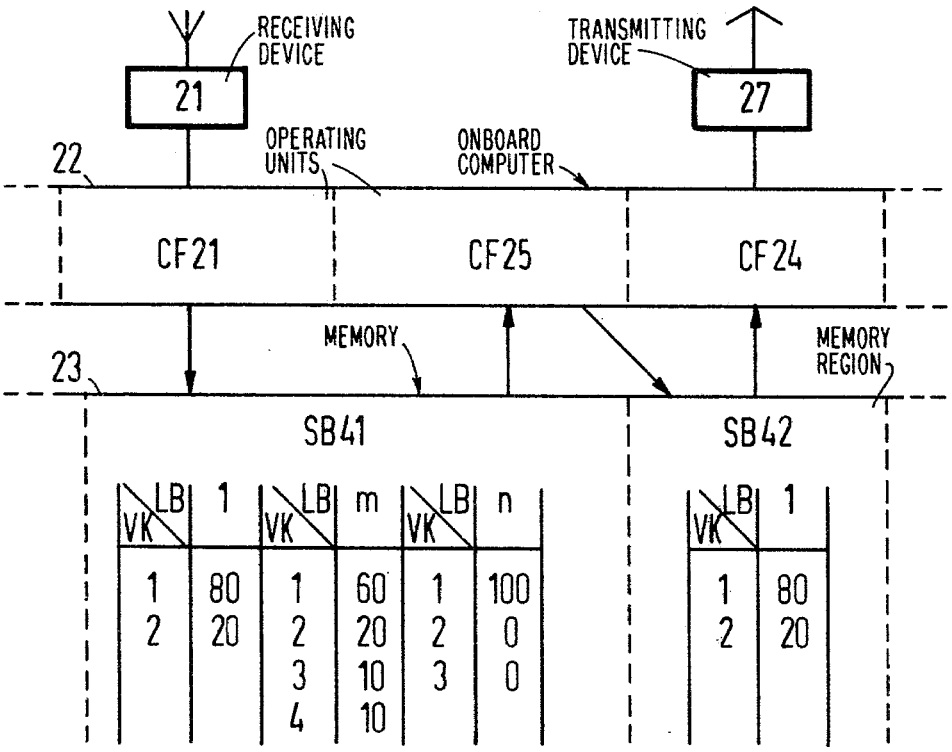
FIG. 5 illustrates additional devices in the vehicle which may be employed in practicing the present invention.

FIG. 5 illustrates additional devices in the vehicle which are required for the retransmission of the distribution values. The receiving devices 21 of all vehicles passing a routing station pole (for example LB2 in FIG. 1) receive data messages which are checked for transmission errors and are prepared by the onboard computer 22 in its region CF21 in a manner which is not described herein in detail. The tables extracted from these messages with the distribution values are stored in the memory region SB41 of the memory 23.

After the onboard computer 22 extracts the data for the route recommendations and, based upon the traveling destination input by the vehicle driver, has decided on one of the route recommendations (route vector chain LV) according to a known method, the next routing station pole which is to be approached is known. The operating unit CF25 with this information can cancel all distribution value data which are intended for other routing station poles in the memory SB41 and can overwrite data for the next destination station pole in the memory region SB42. With the example of the vehicle FZ2 in FIG. 1, only the distribution values for the routing station pole with the address "1" are taken over, the distribution values for other routing station poles are canceled or, respectively, are overwritten in the case of the next routing station pole.

If the vehicle approaches this next routing station pole, then the data present in the memory region SB42 are again called up by the onboard computer 22, in the region CF24 are inserted into the data message for the routing station poles, and together with the empirical data (see text with respect to FIG. 3) are transmitted to the routing station pole.

Figure 6:
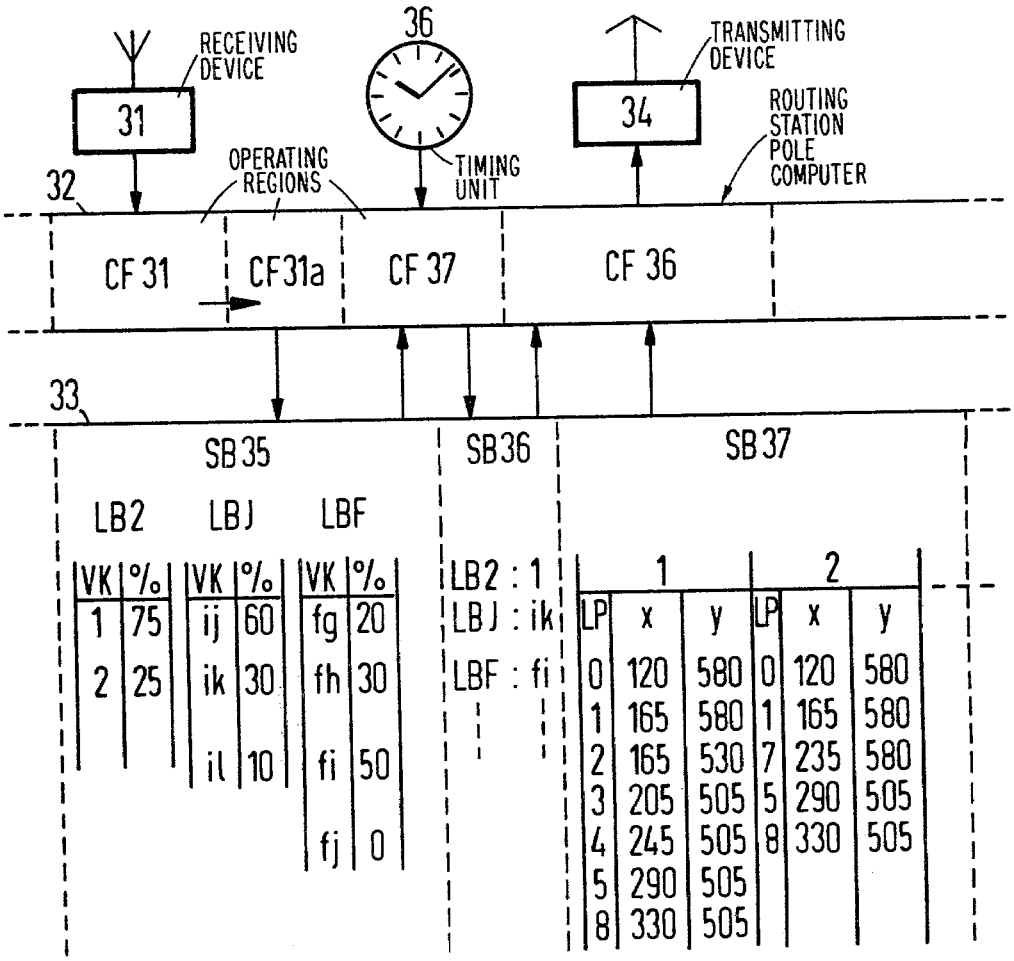
FIG. 6 illustrates additional devices in the routing station pole which may be employed in practicing the present invention.

FIG. 6 illustrates additional devices in the routing station poles which serve for the processing of the distribution values in the routing station poles. The receiving device 31 of the routing station pole (for example routing station pole LB1 of FIG. 1) receives the data messages of all passing vehicles. The messages are checked for transmission errors and are prepared in the operating region CF31 of the routing station pole computer 32 in a known manner which is not described herein. The distribution values (percent numbers in FIG. 4) are transferred to the operating region CF31*a*. There the information is checked as to whether the distribution values are still current. If the traveling times t of the vehicle which transmits the information, in the example the traveling time of the vehicle FZ2 from the routing station pole LB2 to the routing station pole LB1, lie far above the appertaining mean values $\bar{t}$, then the data which were brought over are outdated.

The continuous mean value is formed from current distribution values and is deposited in the memory region SP35. In the memory region 35, therefore, there can be found a current overview of the traffic flow distribution to be aimed for between alternative traveling routes to all neighboring routing station poles. In the example represented, this is a distribution between the vector chains VK1 and VK2 of 75% and 25%. Further, for example, for alternative traveling routes to a routing station pole LBJ, not shown, three alternative traveling routes can exist upon which the traffic is to be distributed according to the ratio 60% (traveling route ij) to 30% (traveling route ik) to 10% (traveling route il). The traffic to a routing station pole LBF, also not shown, could be distributed according to the example presented by way of a route fg with 20%, a route fh with 30%, a route fk with 50% and a route fj with 0%.

The operating region CF37 of the routing station pole computer 32 has the task, with the help of a timing unit 36, of distributing the traffic flows onto the alternative traveling routes in such a manner as is stated by the distribution values (%). This occurs, for example, in that the route vector chain VK1 in 75-out-of-100 time intervals is written into the memory SB36 for attaining the routing station pole LB2. After this, for 25 time intervals, the route vector chain VK2 would be present in this memory region. The same applies for the alternative routes to all other neighboring routing station poles.

The operating unit CF36 of the routing station pole computer 32 compiles the data messages for the vehicles according to the directive set down in the memory region SB36. Now the route point coordinates (x, y) of those vector chains which in that moment are entered in the memory region SB36 are transmitted via the transmitting device to the vehicles.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a method for traffic management in a routing and information system for motor vehicle traffic having a network of stationary routing stations each located in the vicinity of a roadway, in which the routing stations transmit route information and local information concerning their positions to passing vehicles, and in which a trip destination is input into a device onboard a vehicle and transmitted therefrom to a routing station for evaluation so that specific route recommendations may be selected, the improvement therein comprising:

transmitting, from a first routing station to a passing vehicle, a message including suggested route data constituting a vector chain, the address of the first routing station and a start command;

receiving the message from the routing station in the device onboard the vehicle, storing the route data in the onboard device, and activating a travel time measuring device in the vehicle with the received start command; and transmitting, after traveling to a second routing station along the path suggested by the route data, the address of the first routing station, the route data, and the elapsed travel time to the second routing station.

2. The improved method of claim 1, and further comprising the steps of:

transmitting the measured travel times from a plurality of vehicles traversing the same route to a routing station; and forming a changing mean value from the measured travel times.

3. The improved method of claim 2, and further comprising the steps of:

measuring the travel times between individual points along a vector chain included in the stored route data;

storing the individual travel times in the vehicle; and transmitting the stored travel times and the stored route data to the next routing station along the suggested path.

4. The improved method of claim 1, and further comprising the steps of:

storing, in a vehicle, deviation data when the vehicle deviates from a suggested route; and transmitting the deviation data to the next routing station.

5. The improved method of claim 4, and further comprising the steps of:

counting the number of vehicles which deviate from the recommended route passing a routing station; and evaluating the traffic situations between routing stations.

6. The improved method of claim 2, comprising the step of:

interrupting operation of the time measuring device in response to interruptions of travel.

7. The improved method of claim 2, and further comprising the step of:

altering the route recommendations when a predetermined number of vehicles deviate from the suggested route.

8. The improved method of claim 1, and further comprising the step of:

transmitting, from the first routing station, route recommendation data concerning a route starting at the second routing station and directed towards the first routing station.

9. The improved method of claim 1, and further comprising the steps of:

storing, in a vehicle, deviation data when the vehicle deviates from the suggested route;

transmitting the deviation data and the measured travel time to the next routing station along the suggested route; transmitting travel times and deviation data reported by vehicles from the routing stations to a central computer;

evaluating the data at the central computer and forming new route recommendations; and transmitting the new route recommendations to the routing stations.

* * * * *